US006412910B1

(12) United States Patent
Hawkins et al.

(10) Patent No.: US 6,412,910 B1
(45) Date of Patent: Jul. 2, 2002

(54) PERMANENT ALTERATION OF A PRINTHEAD FOR CORRECTION OF MIS-DIRECTION OF EMITTED INK DROPS

(75) Inventors: Gilbert A. Hawkins, Mendon; David L. Jeanmaire, Brockport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 47 days.

(21) Appl. No.: 09/586,099

(22) Filed: Jun. 2, 2000

(51) Int. Cl.[7] ..... B41J 2/14; B41J 2/16; B41J 2/05

(52) U.S. Cl. ..... 347/47; 347/67

(58) Field of Search ..... 347/6, 56, 62, 347/45, 47, 77, 78, 82, 67

(56) References Cited

U.S. PATENT DOCUMENTS 6,012,805 A * 1/2000 Hawkins et al. ..... 347/82

FOREIGN PATENT DOCUMENTS

EP 00890437 A3 1/1999

OTHER PUBLICATIONS

U.S. Patent application No. 08/954,347, filed Oct. 17, 1997, entitled "Continuous Ink Jet Printer With Asymmetric Heating Drop Deflection" by Chwalek et al.

* cited by examiner

*Primary Examiner*—Judy Nguyen
*Assistant Examiner*—Michael S Brooke
(74) *Attorney, Agent, or Firm*—Norman Rushefsky

(57) ABSTRACT

A manner of permanent alteration of an ink jet print head (10) for correction of misdirection of emitted or ejected ink drops. The ink jet print head (10) has a surface (14) defining at least one orifice or nozzle (16) therethrough for emitting or ejecting ink droplets from an ink source onto a printing or recording medium and at least one element (28,30,34,44, 48,50) disposed around the orifice or nozzle (16) and selectably removable for altering a directional path of the ejected or emitted ink droplets, correction of misdirection of emitted or ejected ink droplets from the at least one orifice or nozzle (16) involving asymmetrically removing a portion of the element (28,30,34,44,48,50) disposed around the orifice or nozzle (16).

27 Claims, 9 Drawing Sheets

PERMANENT ALTERATION OF A PRINTHEAD FOR CORRECTION OF MIS-DIRECTION OF EMITTED INK DROPS

BACKGROUND OF THE INVENTION

This invention generally relates to ink jet printers and more particularly relates to a method for permanent alteration of a print head for correcting mis-direction of ink drops emitted therefrom.

An ink jet printer produces images on a receiver by emitting or ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace. The printers can be either "continuous" drop or drop "on demand".

"Continuous" ink jet printers utilize electrostatic charging tunnels that are placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium. Also know the art of continuous ink jet printers includes, inter alia, "thermally steered" ink jets, in which the asymmetric application of heat in portions of a nozzle ring causes the deflection of droplets in a stream, as described in commonly assigned U.S. Pat. No. 6,078,821, Oct. 17, 1997, entitled "Continuous Ink Jet Printer With Asymmetric Heating Drop Deflection", by Chwalek et al.

In the case of "on demand" ink jet printers, at every ink emitting or ejecting orifice or nozzle a pressurization actuator is used to produce the ink jet droplet. In this regard, either one of two types of actuators may be used. These two types of actuators are heat actuators (as commercialized, for example, by Canon Inc. under the trade name "Bubble Jet" and by the Hewlett Packard Company) and piezoelectric actuators (as commercialized, for example, by Epson). With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material is used, which piezoelectric material possesses piezoelectric properties such that an applied electric field will produce a mechanical stress in the material. The most commonly produced piezoelectric ceramic is lead zirconate titanate. Also known in the art of drop on demand printing are devices in which heat is applied symmetrically to the air-ink meniscus by means of a nozzle rim disposed around the ink ejection orifice to effect droplet ejection as taught in EP00890437A3 by Silverbrook. The nozzle rim is generally made of a resistive heater material such as doped polysilicon which is heated by the passage of an electrical current.

In the instance of both continuous and on demand ink jet printers, it has been found that when larger numbers of ink ejecting orifices or nozzles are formed on a print head, small variations in the directional path of ink drop emission or ejection from nozzle to nozzle or orifice to orifice will be present. Such variations typically result from manufacturing non-uniformities; and cause reduced image quality and in the instance of continuous ink jet systems, catastrophic failure if the variation in drop direction is sufficient to prevent guttering. Such variant nozzles, due to the precise requirements for ink droplet size, and the small size of the orifices and nozzles cannot be repaired, absent burdensome and disadvantageous cost. Therefore, corrections tend to be temporary adjustments. In the case of continuous ink jet printers utilizing electrostatic deflection, some correction for misdirection of drops has been achieved by adjusting the voltages applied to each deflection electrode individually during the printing of each drop. However this method is expensive and generally capable of adjusting the direction of drop deflection in only a single direction. In the case of thermally steered ink jet printers, some correction for mis-direction of drops can be achieved by adjusting the voltages applied to heater segments during the printing of each drop. However this method is also expensive and difficult to manufacture. Both corrective methods are unduly complex because the correction must be re-applied for each printed drop.

Therefore, there is a need for a manner of precisely altering a print head to redirect errant ink droplets without having to replace the ink emitting nozzles and orifices.

SUMMARY OF THE INVENTION

An object of the present invention is to provide a method and an article for altering a print head in order to redirect the errant path of emitted or ejected ink drops, in a permanent fashion which does not require replacing the ink ejecting orifices (also sometimes referred to as "nozzles").

With this object in view, a primary aspect of the present invention resides in an ink jet print head having a surface, defining at least one orifice therethrough for "emitting" (also sometimes referred to as "ejecting") ink droplets from an ink source onto a "printing" (sometimes referred to as "recording") medium, and at least one element disposed around the orifice. That element is selectably removable for altering a directional path of the emitted ink droplets. The emitted ink droplets are thereby redirected from the at least one orifice by asymmetrically removing a portion of the element disposed around the orifice.

According to an exemplary aspect of the present invention, during fabrication or manufacture of the printhead, a deformation control element made from nitride, polysilicon, metal, etc., is applied under mechanical, stress from the energy of its application. For example, plasma or vapor deposition techniques can be employed to deposit the elements symmetrically around each orifice and atop an orifice membrane region. Because the element is symmetrically deposited around the orifice, the direction of an ink drop emitted therefrom is not changed by the presence of the deposited material so long as the membrane region underneath the deposit is also symmetrical. Upon detection of a variant orifice, a portion of the deformation control element is removed, for example, by laser ablation in order to asymmetrically alter an aspect of the orifice such that droplets follow an altered directional path.

According to another exemplary aspect of the present invention, applied advantageously to thermally steered ink jet printers, during print head fabrication, an element of a thermal conduction control material, for example, an evaporated metal, is deposited symmetrically surrounding each nozzle or orifice over the region of the orifice membrane. Because this material is symmetrically disposed, the direction of an emitted or ejected droplet is not changed if the underlying membrane and nozzle are also symmetrical, regardless of whether the thermal conduction material is energized or heated. Upon detection of a variant nozzle, a portion of the thermal conduction control material is removed, for example, by laser ablation, to the extent that during heater activation, the heat applied is asymmetric in a way so as to cause the heater deflected droplets to be directed or steered along a desired directional path. In the absence of heater activation, no alteration in deflection of the droplets occurs.

According to another exemplary aspect of the present invention, during print head fabrication, an element including a symmetric fluid contact ring is positioned surrounding each nozzle or orifice for controlling direction of ink droplet ejection or emission by the effect of surface tension force, both for deflected and undeflected droplet emission. Upon detection of a variant nozzle, a portion of the fluid contact ring is removed, for example by laser ablation, to the extent that the direction path of the ejected ink droplets is correspondingly altered.

According to still another exemplary aspect of the present invention, during print head fabrication, an element including a symmetrical hydrophobic material for controlling ink meniscus profile is formed surrounding each nozzle or orifice. Because the hydrophobic material is symmetrically disposed, the direction of an emitted or ejected ink droplet is not changed. Upon detection of a variant nozzle or orifice, a circumferential portion of the hydrophobic material is removed, again for example by laser ablation, to the extent that the directional path of emitted or ejected ink droplets is correspondingly altered.

According to still another exemplary aspect of the present invention, during print head fabrication, a symmetrical lateral flow blocking element for controlling ink meniscus profile is formed surrounding each nozzle or orifice. Because the lateral flow blocking element is symmetrically disposed, the direction of an emitted or ejected ink droplet is not changed. Upon detection of a variant nozzle, a circumferential portion of the lateral flow blocking element is removed, again for example by laser ablation, to the extent that the directional path of emitted or ejected ink droplets is correspondingly altered.

According to still another exemplary aspect of the present invention, applied advantageously to thermally steered ink jet printers, during print head fabrication, an element including a symmetrical heat blocking or insulating layer for controlling ink meniscus profile is formed surrounding each nozzle or orifice. Because the heat blocking or insulating layer is symmetrically disposed, the direction of an emitted or ejected ink droplet is not changed. Upon detection of a variant nozzle, a circumferential portion of the heat blocking or insulated layer is removed, again, for example by laser ablation, to the extent that the directional path of emitted or ejected ink droplets is correspondingly altered.

A feature of the present invention is a symmetrical element extending around an ink ejecting orifice or nozzle, the element being selectably removable or alterable for correspondingly altering a directional characteristic of the emitted or ejected ink droplets.

Another feature of the present invention is the capability to alter an ink jet print head to correct directional deficiencies, the alteration being permanent in the sense that the corrective procedure need not be reapplied to each printed drop.

Another feature of the present invention is the capability to alter an ink jet print head to correct directional deficiencies in ink emission or ejection without effecting changes to the orifice or nozzle itself.

An advantage of the present invention is that image quality is improved and catastrophic failures due to guttering problems are avoided in the case of continuous ink jet printers.

Another advantage of the present invention is that the alteration of the print head provides a cost advantage over alternative corrective steps.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 2:
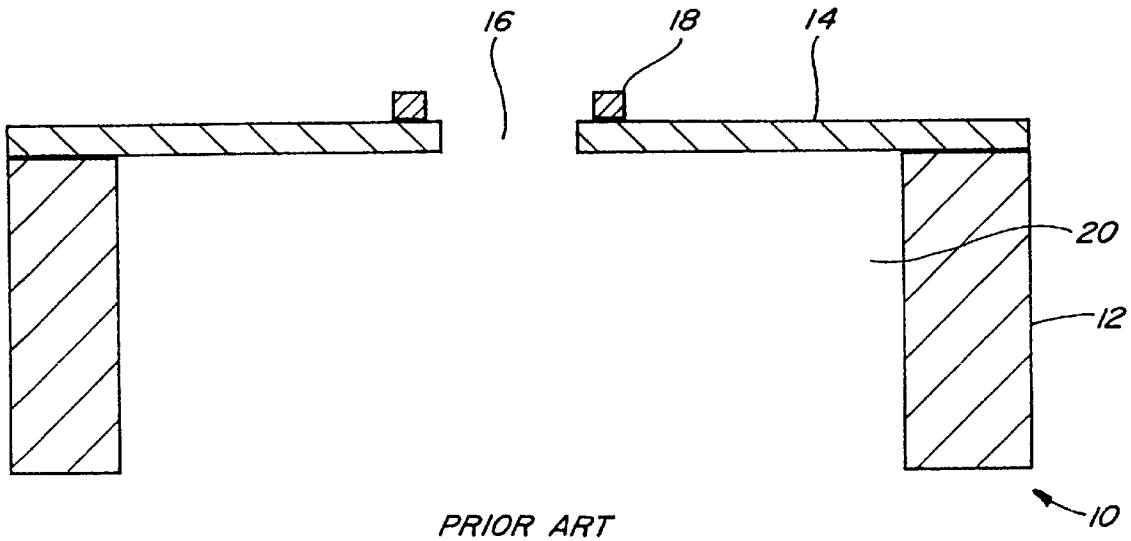
PRIOR ART Fig. 2
FIG. 2 is a cross-sectional view of the prior art print head of FIG. 1 taken along line 2—2 thereof.
Figure 1:
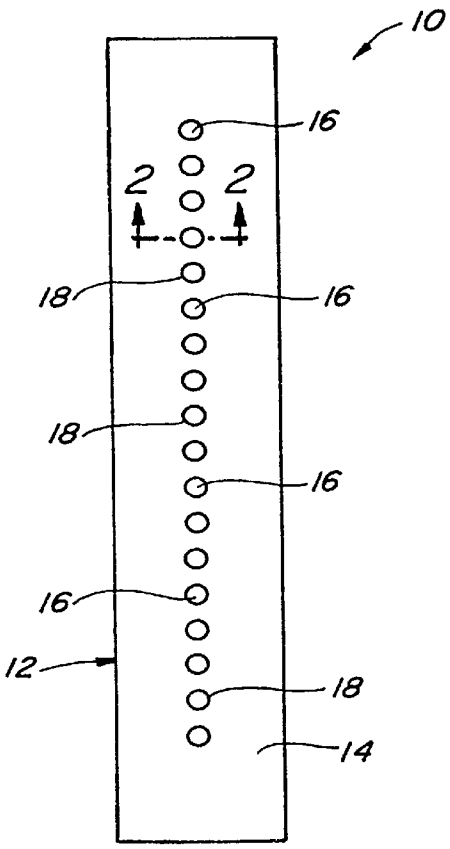
PRIOR ART Fig. 1
FIG. 1 is a front view of a typical prior art print head.

Therefore, referring to FIGS. 1 and 2, a typical prior art ink jet print head 10 of the type having a nozzle ring, as taught in commonly assigned co-pending U.S. Pat. No. 6,079,821 and also in EP00890437A3 is shown including a body 12 of a conventional material, such as, but not limited to, materials used to fabric CMOS devices. Body 12 has a front surface 14 including a plurality of ink-ejection orifices 16 therein arranged in a linear array. Each ink ejection nozzle 16 is encircled by a nozzle rim 18 disposed on front surface 14 and extends from surface 14 through the substrate thereof to a respective ink channel 20 connected in fluid communication to a supply of ink (not shown). Print head 10 is conventionally operable to selectably cause ink contained in the respective ink channels 20 to be printed as droplets onto a receiver such as a paper or transparency disposed opposite nozzles 16, for instance, by heating the nozzle ring. Typically, printheads are comprised of multiple nozzles 16 as described in EP00890437A3 by Silverbrook.

In the cases of drop on demand printers of the type made using heat actuators (Bubble Jet) or piezoelectric actuators or in the case of continuous ink jet printers of the electrostatic type, there is generally no heatable nozzle rim 18 and in these cases the corresponding prior art are identical to FIGS. 1 and 2 except nozzle rim 18 is absent. In these cases, print head 10 is conventionally operable to selectably eject or emit ink contained in the respective ink channels 20 through the ink ejection nozzles 16 onto a receiver such as a paper or transparency disposed opposite nozzles 16, for instance, using heating elements (not shown) located in front surface 14 which are energized to heat the ink to generate a vapor bubble, or piezoelectric elements (also not shown) which produce a mechanical stress for ejecting ink droplets when an electrical field is applied to the elements. Although the present invention will be described in terms of a printhead having a nozzle rim, such a rim is not generally a requirement.

Ideally, ink will be ejected through of nozzles 16 of printhead 10 along aligned or uniform directional paths, generally perpendicular to the printhead front surface. In cases of printheads having multiple nozzles 16, the paths of ink droplets ejected from each of the nozzles would be desired to be parallel. However, due to manufacturing non-uniformities and the like, the directional paths of ink ejected from some nozzles 16 will vary from the norm. Such variations reduce image quality, and, in the case of continuous ink jet systems, can be catastrophic if the variation in the directional path is sufficient to prevent guttering. Nozzles 16 observed to eject ink along such variant directional paths, or observed to be formed so as to eject ink along a variant directional path, are known as variant nozzles.

Figure 3A:
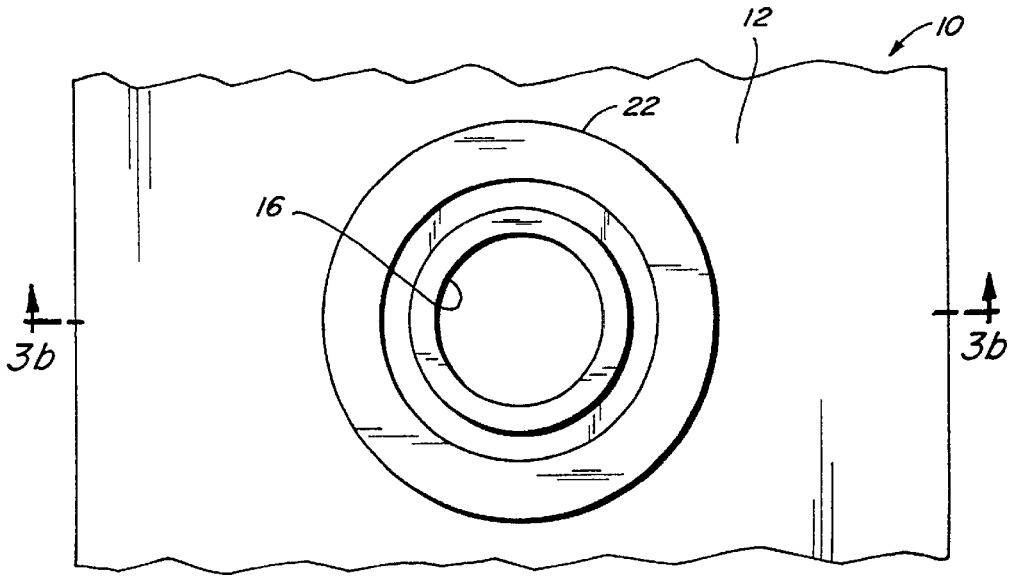
FIG. 3*a* is a fragmentary front view of a print head similar to the print head of FIG. 1, showing an ink ejecting nozzle of the print head with a selectably removable element disposed symmetrically around the nozzle.
Figure 3C:
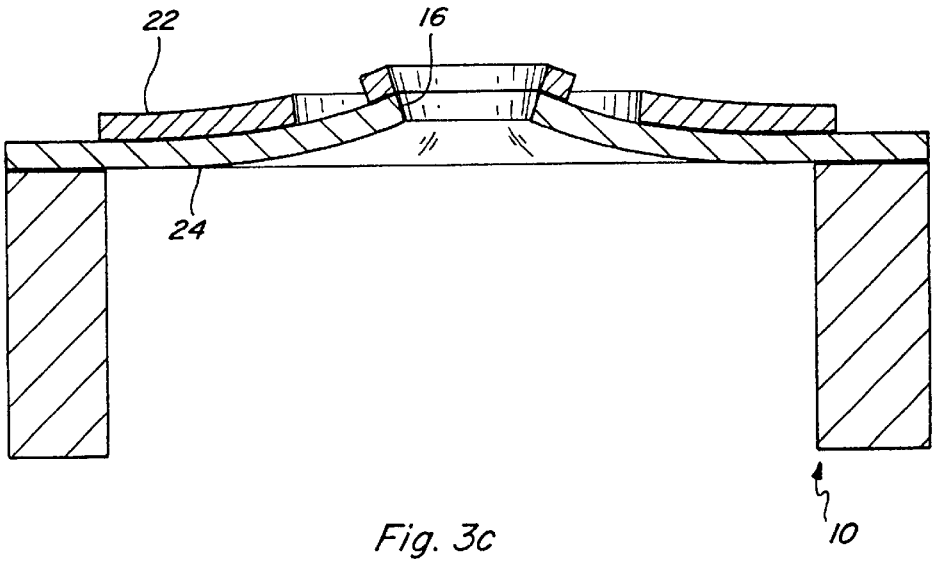
FIG. 3*c* is a cross-sectional view of the print head of FIG. 3*a* illustrating the element in a symmetrical mechanically stressed state during ejection of an ink droplet through the nozzle.
Figure 3B:
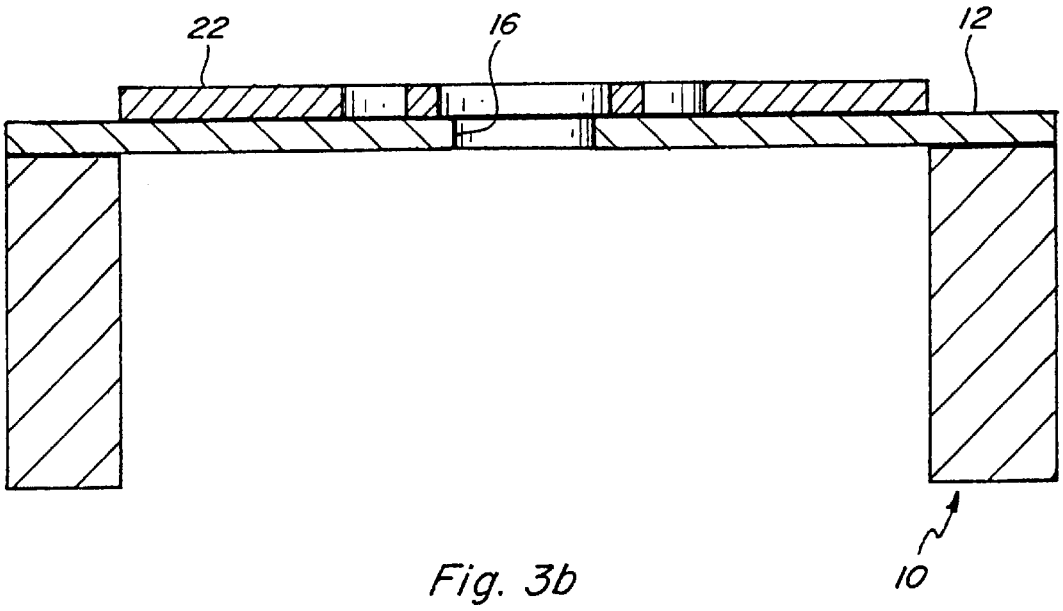
FIG. 3*b* is a cross-sectional view taken along line 3*b*—3*b* of FIG. 3*a* illustrating the element in a mechanically relaxed state.

Turning to FIGS. 3*a* and 3*b*, a front surface 14 of an ink jet print head 10 is shown including an element 22 of a deformation control material disposed over an orifice membrane region 24 of the print head around a nozzle 16 thereof. The deformation control material can include, for instance, a plasma deposited nitride or polysilicon or an evaporated metal, which is deposited symmetrically surrounding nozzle 16 during the manufacture of the print head. In FIG. 3*b*, the deformation control material has been deposited in such a way that the orifice membrane region 24 remains flat, for example by depositing deformation control material having a very low value of stress. In the preferred embodiment, however, orifice membrane region 24 is bent by the deformation control material, for example by depositing the deformation control material in a state of tensile stress, as is well known in the art of thin film deposition. This condition is shown in cross-section in FIG. 3*c*.

Referring to FIG. 3*c*, because the deformation control material of element 22 is symmetrically disposed, element 22 will not alter the direction of ejection of an ink droplet through nozzle 16, as long as underlying membrane 24 and nozzle 16 are also symmetrical, as illustrated. Thus, elements 22 can be placed around all of the respective nozzles 16 of an ink jet print head, such as print head 10, whether or not some of the nozzles 16 are variant nozzles, since the direction of ejection from non-variant nozzles will not be changed. Then, upon detection of a variant nozzle, a selected portion of element 22 around the variant nozzle can be removed, for example by laser ablation, to the extent that the mechanical position or orientation of nozzle rim 18 is asymmetrically altered to cause the emitted ink drops to be effectively steered to a new, desired directional path.

Figure 4A:
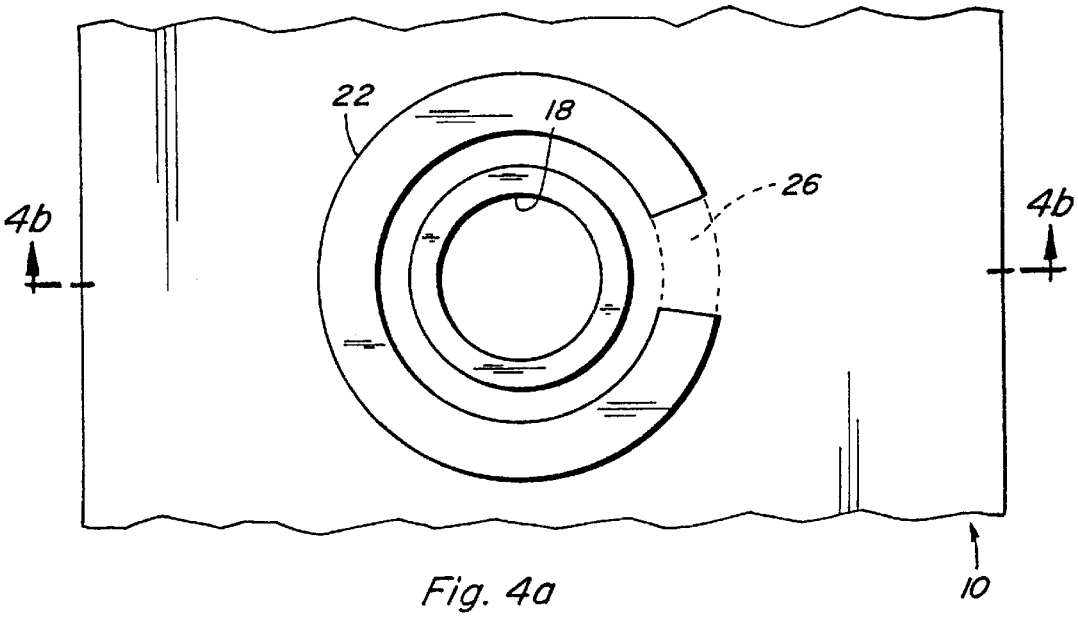
FIG. 4*a* is a fragmentary front view of the print head of FIG. 3*a* showing a circumferential portion of the element removed.
Figure 4B:
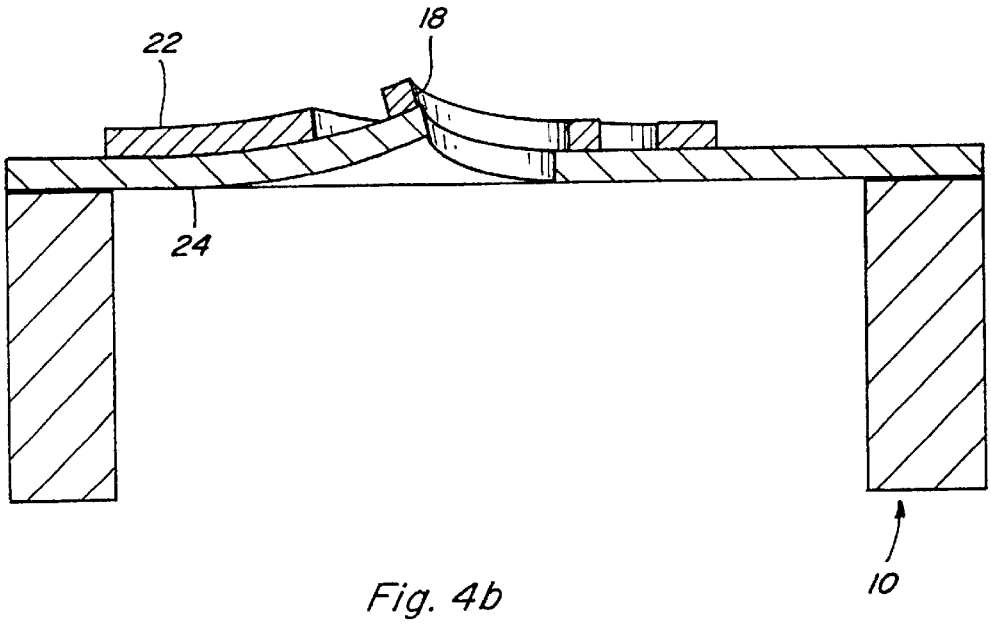
FIG. 4*b* is a cross-sectional view taken along line 4*b*—4*b* of FIG. 4*a* showing the element asymmetrically deformed under mechanical stress for altering the directional path of ink droplets ejected through the nozzle.

This effect is illustrated in FIGS. 4*a* and 4*b* wherein a circumferential portion 26 of element 22 is removed such that orifice rim 18 is asymmetrically altered, with the above-discussed effect being shown. In FIG. 4*b* for example, drops which would be steered to the right upon removal of circumferential portion 26. Although the present embodiment has been described in terms of a printhead having a nozzle rim, such a rim is not a requirement.

Figure 5A:
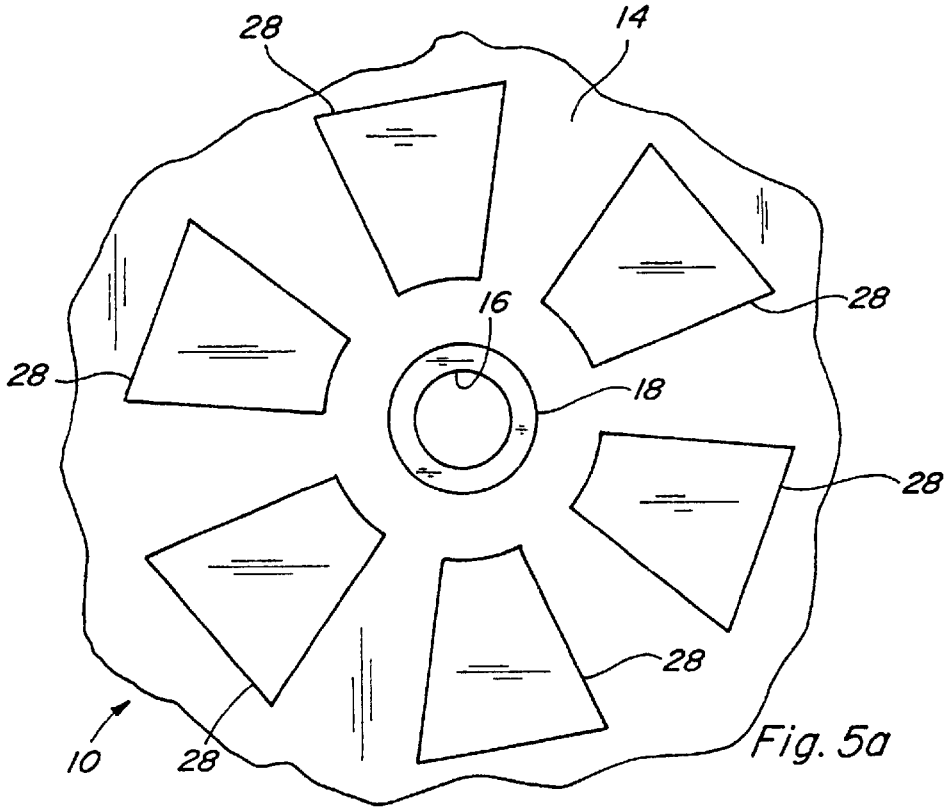
FIG. 5*a* is a fragmentary front view of a print head including an ink ejecting nozzle and showing elements of a deformation control material symmetrically disposed around the nozzle.
Figure 5B:
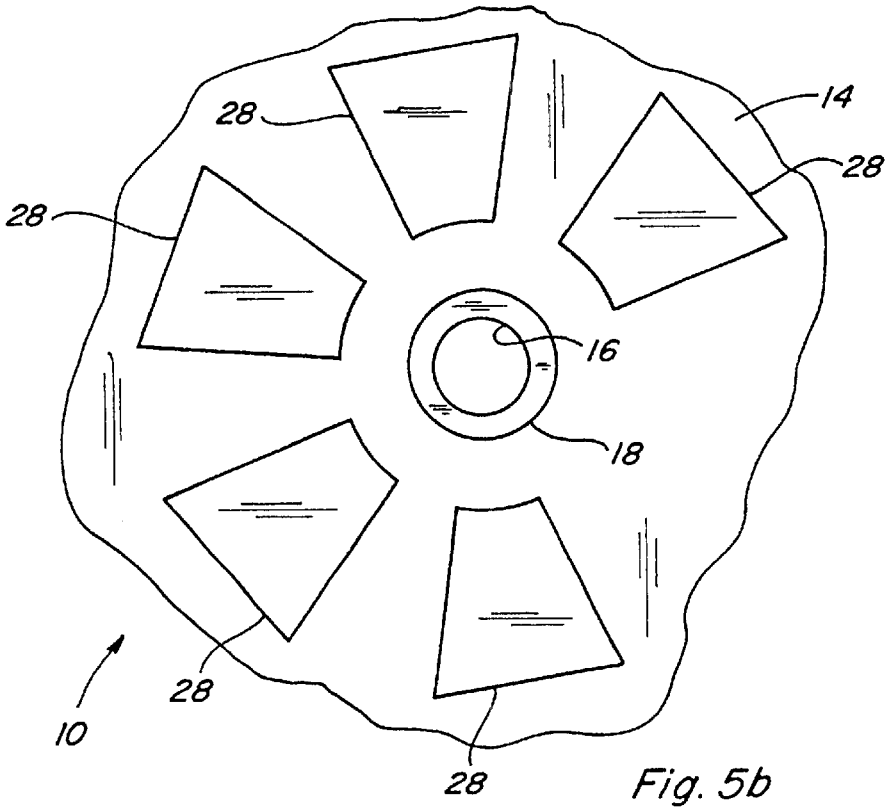
FIG. 5*b* is another front view of the print head of FIG. 5*a* showing one of the elements removed for altering the directional path of ink droplets ejected through the nozzle.

The deformation control material need not be deposited in the form of a simple ring. Turning to FIGS. 5*a* and 5*b*, the front surface 14 of a print head 10 is shown including a plurality of non-contiguous elements 28 of a deformation control material deposited during fabrication of the print head, for example, a plasma deposited nitride or polysilicon or an evaporated metal, symmetrically surrounding nozzle 16, one of elements 28 being shown removed in FIG. 5*b* to asymmetrically alter the mechanical position or orientation of nozzle rim 18 for steering or redirecting ink droplets ejected through nozzle 16 along a different directional path in a manner essentially identical to that discussed in relation to FIGS. 4*a* and 4*b* . In this embodiment, it is advantageous that the deformation control material is deposited in non-contiguous elements because the amount of material removed during removal of an entire element, for example by laser ablation, is not sensitive to the exact area subjected to laser ablation so long as that area is larger than the non-contiguous element to be removed but small enough not to remove any deformation control material from a neighboring non-contiguous element. Although this embodiment has been described in terms of a printhead having a nozzle rim, such a rim is not a requirement.

Figure 6A:
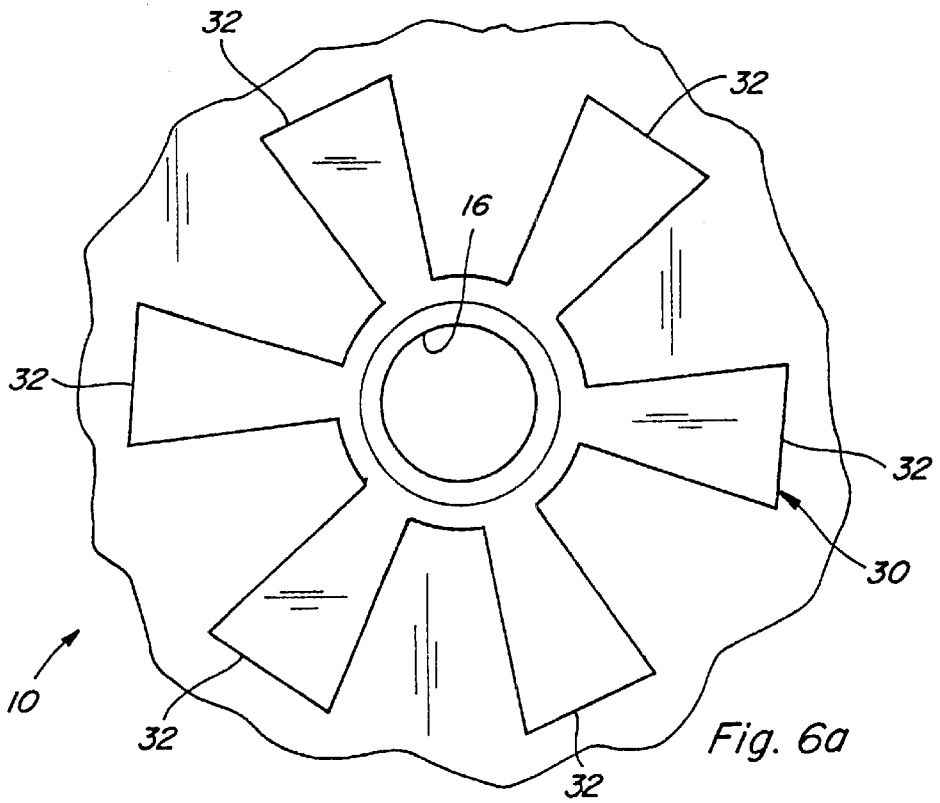
FIG. 6*a* is a fragmentary front view of a print head including an ink ejecting nozzle having an element of a deformation control material symmetrically disposed around the nozzle.
Figure 6B:
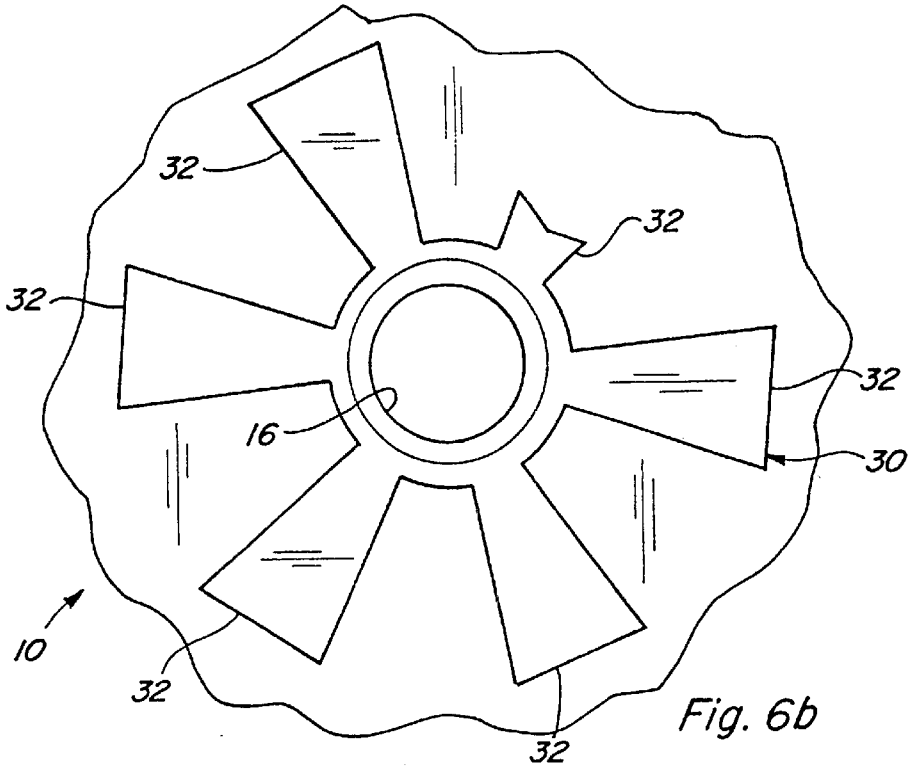
FIG. 6*b* is another front view of the print head of FIG. 6*a* showing a circumferential portion of the element removed for altering the directional path of ink droplets ejected through the nozzle.

Referring to FIGS. 6*a* and 6*b*, a front surface 14 of an ink jet printhead 10 is shown including an element 30 of a thermal conduction control material, for example an evaporated metal such as titanium or gold, deposited at the time of manufacture symmetrically surrounding a nozzle 16 of the print head 10. Element 30 includes a plurality of circumferential portions 32 at angularly spaced locations around nozzle 16, as shown in FIG. 6*a*. For the case of printheads such as those described in EP00890437A3 the directional path of an ink drop emitted from nozzle 16 will not be changed by the presence of element 30, if the underlying membrane 24 and nozzle 16 are also symmetrical, regardless of whether or not energy is applied to element 30 for heating it. FIG. 6*b* shows element 30 with a selected circumferential portion 32 thereof removed, for example by laser ablation, to the extent such that when energy is applied to nozzle rim 18 so as to heat it, the rise in temperature of the nozzle rim is correspondingly generated asymmetrically, the rise being more in that portion of the nozzle nearest the removed circumferential portion because heat is not conducted away from the nozzle rim by the presence of thermal conduction control material there. When the temperature rise is generated asymmetrically, the heat deflected ink droplets are steered to a new, desired directional path. In this case, the drops are steered away from the removed selected circumferential portion, as discussed in commonly assigned U.S. Pat. No. 6,079,821 filed Oct. 17, 1997, "Continuous Ink Jet Printer with Asymmetric Heating Drop Deflection."

For the case of printheads such as those described in U.S. Pat. No. 6,079,821 in which heat is always applied to the nozzle rims asymmetrically to steer drops during printing, the presence of element 30 alters the amount of steering when heat is applied and does not alter the direction of drops when heat is not applied. In this case, when a selected circumferential portion 32 of the thermal conduction control material is removed, heat deflected ink droplets are steered to a new, desired directional path in comparison to the path taken by heat deflected droplets before removal of the circumferential portion. In this case, the drops are again steered away from the removed circumferential portion because this region is hotter after removal.

Figure 7A:
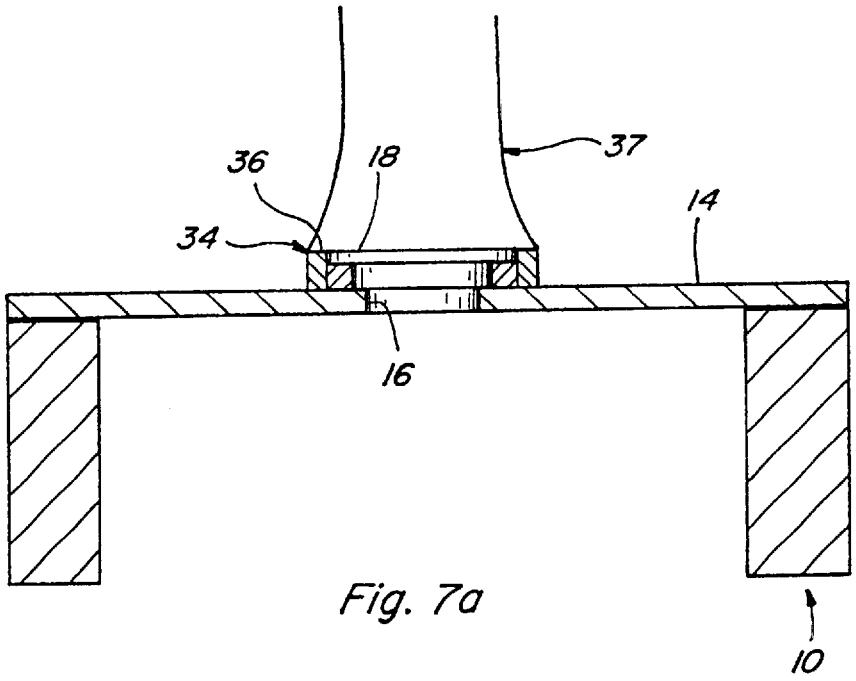
FIG. 7*a* is a cross-sectional view of a print head showing an ink ejecting nozzle having a symmetrical fluid contact ring disposed therearound.
Figure 7B:
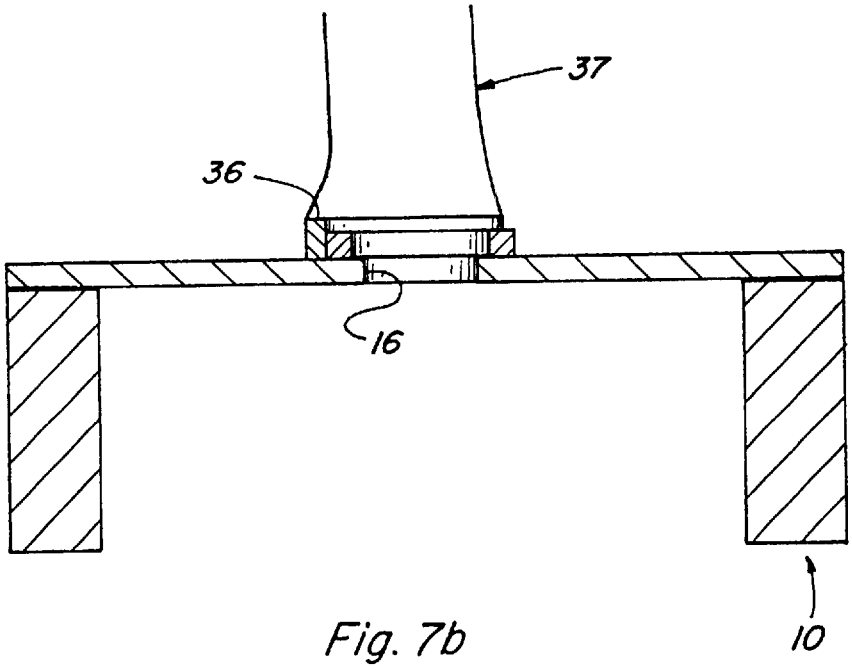
FIG. 7*b* is a cross-sectional view of the print head of FIG. 7*a* showing a circumferential portion of the fluid contact ring removed for altering the directional path of ink droplets ejected through the nozzle.

Referring now to FIG. 7*a*, another ink jet print head 10 is shown including a selectably removable element 34 which is a fluid contact ring 36 disposed on front surface 14 symmetrically around the nozzle ring 18 of one of the ink ejection nozzles 16 during fabrication of the print head. Fluid contact ring 36 is adapted to affect or influence the directional path of the ink meniscus 37 ejected from nozzle 16 by surface tension force between ring 36 and the ink 37 when in contact therewith, both for drops being deflected and drops not being deflected. Preferably, the fluid contact ring is chosen to be hydrophilic in order that the ink, which is preferable aqueous, is energetically disposed to be in contact with the fluid contact ring, as is well known in the art of fluid-surface interactions. Because the fluid contact ring 36 is symmetrically disposed, it will not alter the direction of ejection an ink droplet through nozzle 16 because the surface tension forces between ring 36 and the ink pull equally left and right in FIG. 10. Thus, elements 34 can be placed around all of the respective nozzles 16 of an ink jet print head, such as print head 10, whether or not some of the nozzles 16 are variant nozzles, since the direction of ejection from non-variant nozzles will not be changed. Then, upon detection of a variant nozzle, a selected portion of element 34 around the variant nozzle can be removed, for example by laser ablation, to the extent that the surface tension forces between ring 36 and the ink are asymmetrically altered to cause the emitted ink drops to be effectively steered to a new, desired directional path. The change in direction of the ejected droplets upon removal of a selected portion of element 34 will depend on the exact shape of the ink meniscus during drop ejection and upon the exact type of printhead. FIG. 7*b* is another view of the print head 10 of FIG. 7*a* showing fluid contact ring 36 with a circumferential portion thereof removed to alter the surface tension force and thus the directional path of the ink droplets ejected from nozzle 16.

Although the present embodiment has been described in terms of a printhead having a nozzle rim protruding above the front surface 14 of the printhead 10, such a rim is not a requirement so long as the fluid contact ring 36 is positioned near enough to the orifice so as to contact the ink 37. For example in FIG. 8, an inkjet printhead 10 is shown having a heatable nozzle rim embedded in planarizing element 38 whose top surface is coplanar with the top surface of planarizing element 38. A selectably removable element 34, which is again a fluid contact ring 36, is shown symmetrically disposed around nozzle 16. As in the discussion of the invention in accordance with FIG. 7*a* and 7*b*, a selected circumferential portion of fluid contact ring 36 can be removed to permanently alter the directional path of ink droplets ejected through nozzle 16 in comparison to the path of ink droplets ejected before removal of the circumferential portion. Here again, the directional path is permanently altered, regardless of whether the ink droplets are deflected by heater element 38, or not deflected. Although the present embodiment has been described in terms of a printhead requiring a heatable nozzle rim for operation, such as printheads described in commonly assigned U.S. Pat. No. 6,079,821 permanent alteration of the directional path of droplets ejected by other types of printheads, such as Bubble Jet printheads, can be achieved by removing selected portions of a fluid contact ring previously deposited about the drop ejection nozzle in accordance with the present invention so long as the fluid contact ring is positioned near enough to the ejection nozzle so as to contact the ink.

Figure 8:
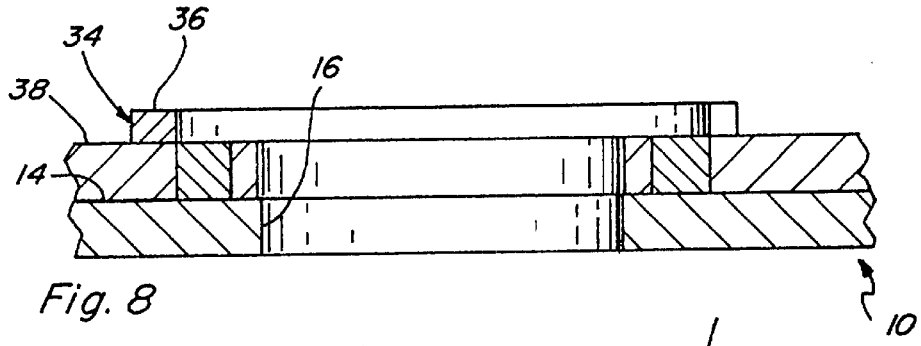
FIG. 8 is a sectional view of a print head having a symmetrical fluid contact ring disposed around a nozzle thereof in association with a planar heater for effecting the ejection of ink droplets through the nozzle, showing a circumferential portion of the fluid contact ring removed to alter the directional path of ink droplets ejected through the nozzle.
Figure 9:
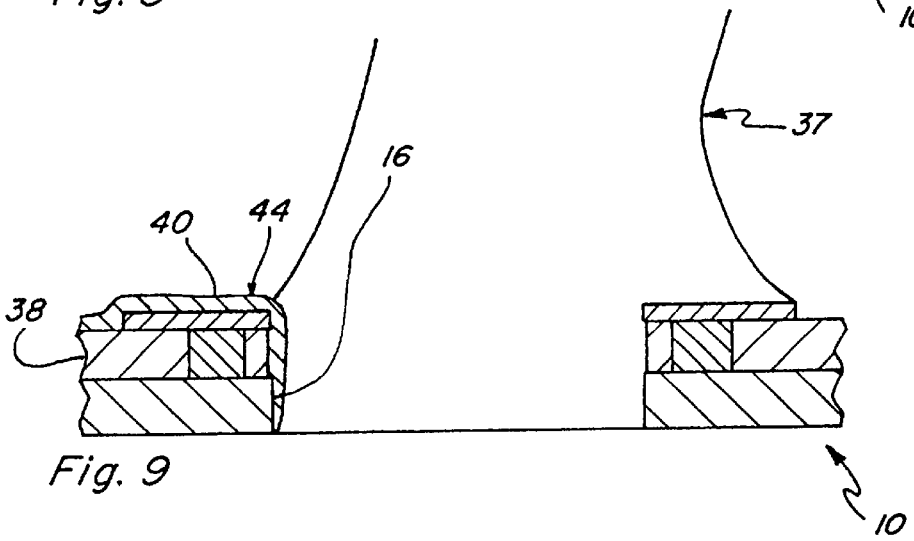
FIG. 9 is a sectional view of a print head having a fluid contact ring symmetrically disposed around an ink ejecting nozzle thereof coated with an element of a hydrophobic material, showing a circumferential portion of the hydrophobic material removed to alter the directional path of the ink droplets ejected through the nozzle.
Figure 10:
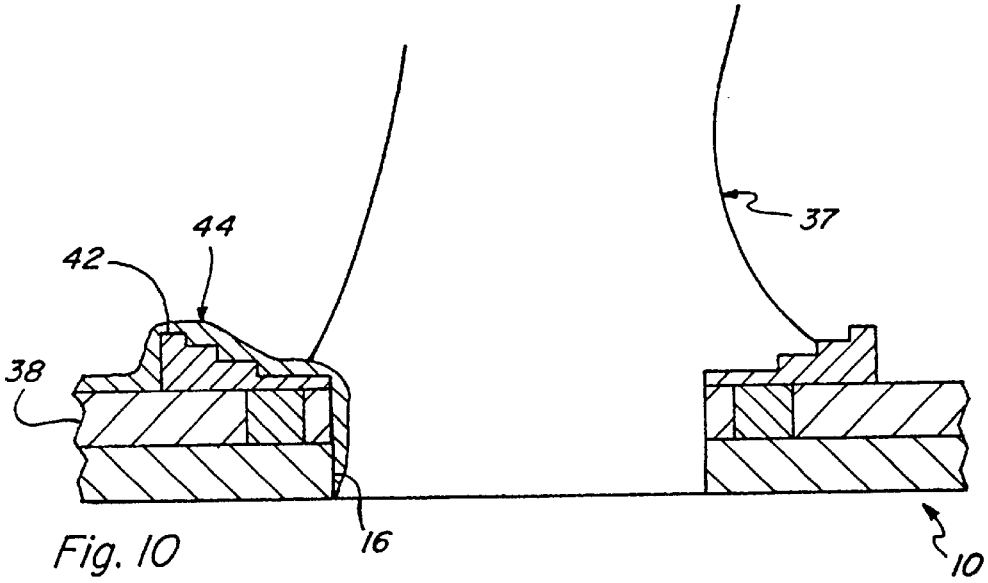
FIG. 10 is a sectional view of a print head including a fluid contact ring having a stepped profile shape and coated with a hydrophobic material symmetrically disposed around an ink ejecting nozzle thereof, showing a circumferential portion of the hydrophobic material removed to alter the directional path of ink droplets ejected through the nozzle.

Turning to FIGS. 9 and 10, the ink jet printhead 10 of FIG. 8 is shown including alternative fluid contact ring constructions symmetrically disposed over planar heating element 38 around nozzle 16, including a fluid contact ring 40 (FIG. 9) having a substantially flat profile shape, and a fluid contact ring 42 (FIG. 10) having a stepped profile shape. Preferably, the fluid contact rings 40 and 42 are chosen to be hydrophilic in order that the ink, which is preferable aqueous, is energetically disposed to be in contact with the fluid contact ring, as is well known in the art of fluid-surface interactions. Rings 40 and 42 as well as the surfaces of nozzles 16 and heaters 38 are shown covered by a selectably removable element 44 which is a layer of hydrophobic material 46, for instance a fluorinated hydrocarbon film or a wax film, which affects the directional path of ink droplets ejected through nozzle 16 by controlling the meniscus profile of the droplets, namely by increasing the contact angle of the meniscus on the hydrophobic material, as is well known in the art of fluid-surface interactions. A circumferential portion of the hydrophobic material 46 about nozzle 16 is shown permanently removed, for instance by laser ablation, in the right-hand side of the cross-sections of FIG. 9 and FIG. 10 in order to alter the meniscus profile so as to effect a change in the directional path of the ejected ink droplets. The hydrophobic material may also be removed by application of heat from sources other than a laser, for example by operating heaters which are a part of the printhead itself.

Figure 11:
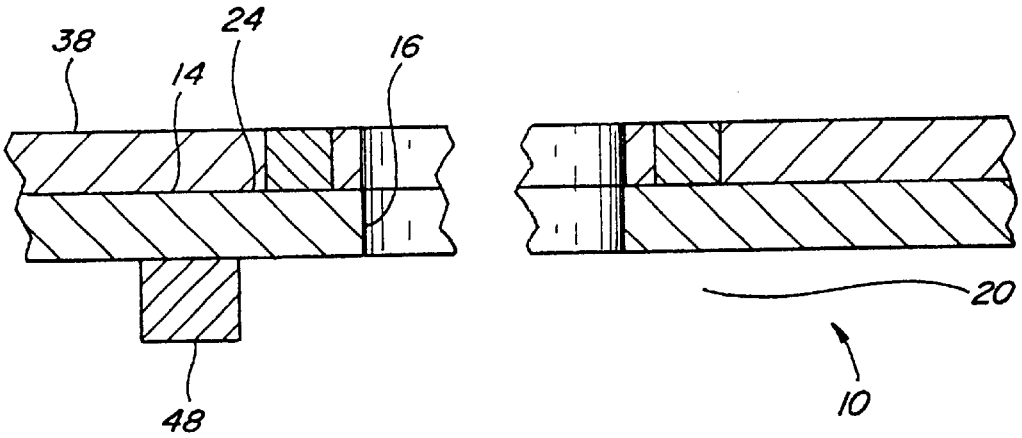
FIG. 11 is a cross-sectional view of a print head having a lateral flow blocking element symmetrically disposed around an ink ejecting nozzle thereof, showing a circumferential portion of the flow blocking element removed for altering the directional path of ink ejected through the nozzle.

In yet another preferred embodiment of the present invention, FIG. 11 shows an ink jet print head 10 including a planar heater element 38 disposed on front surface 14 thereof over nozzle membrane region 24 and a selectably removable lateral ink flow blocking element 48 disposed on a surface of nozzle membrane region 24 symmetrically around nozzle 16 in communication with ink channel 20, a circumferential portion of lateral flow blocking element 48 being permanently removed for unbalancing the ink flow profile in the region of nozzle 16 for effecting a change in the directional path of ink droplets ejected through nozzle 16. Although the present embodiment has been described in terms of a printhead requiring a heatable nozzle rim for operation, such as printheads described in commonly assigned U.S. Pat. No. 6,079,821 permanent alteration of the directional path of droplets ejected by other types of printheads, such as Bubble Jet print heads, can also be achieved by removing selected portions of a lateral ink flow blocking element 48. For continuous ink jet printers, the change is effected for both ink droplets that are deflected and those that are not deflected.

Figure 12:
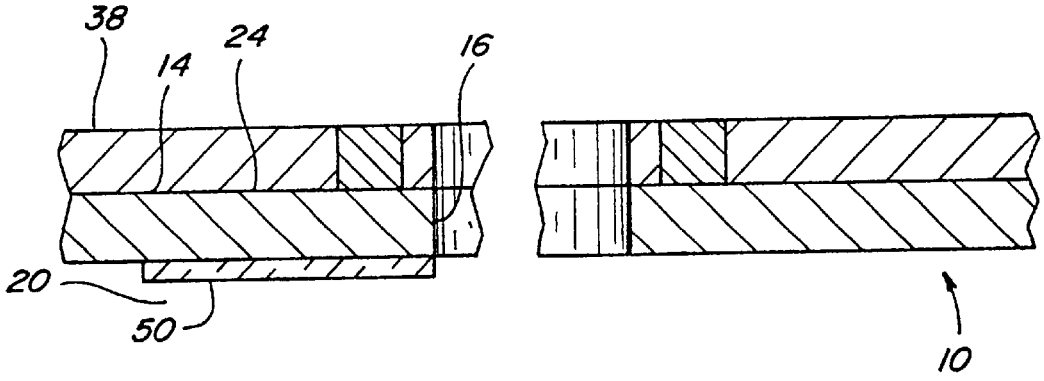
FIG. 12 is a sectional view of a print head having a heat blocking layer symmetrically disposed around an ink ejecting nozzle thereof, showing a circumferential portion of the layer removed to alter the directional path of ink droplets ejected through the nozzle.

FIG. 12 shows an ink jet print head 10 including a planar heater element 38 disposed on front surface 14 thereof over nozzle membrane region 24 and a selectably removable heat spreading element 50, for instance titanium, tantalum, gold, or nickel, disposed on a surface of nozzle membrane region 24 in communication with ink channel 20 symmetrically around nozzle 16, a circumferential portion of heat spreading element 50 being permanently removed for unbalancing the temperature profile of the ink in the region of nozzle 16 for effecting a change in the directional path of ink droplets ejected through nozzle 16. This embodiment is most appropriately applied to printheads requiring a heatable nozzle rim for operation, such as printheads described in commonly assigned U.S. Pat. No. 6,079,821.

It may be appreciated from the description hereinabove, that by deposition of the removable elements of the present invention on a print head at the time of manufacture and the subsequent removal of circumferential portions thereof around variant nozzles, a simple, inexpensive manner of correction of the directional path of the ink from the variant nozzles is obtained. It may also be appreciated from the description hereinabove that the present invention has utility for use with a wide variety of print head constructions, including, but not limited to, those for continuous and on demand printers as shown, as well as others. Still further, it may be appreciated from the description hereinabove that selection of the location and amount or extent of an element to be removed for correction of a particular variant condition may be required to be determined on an application by application basis, and that various manners of removal other than by laser ablation may be used or required, including removal by operation of the printhead itself.

The mechanical arrangements described above are but a few examples of practice of the present invention. Many different configurations are possible.

Therefore, what is provided is a manner of alteration of a print head for correction of misdirection of emitted or ejected ink drops which is permanent and does not require correction of the ink ejecting orifices or nozzles themselves.

PARTS LIST

10 . . . ink jet print head
12 . . . body
14 . . . front surface
16 . . . ejection nozzle
18 . . . nozzle rim
20 . . . ink channel
22 . . . element
24 . . . orifice membrane region
26 . . . circumferential portion
28 . . . elements
30 . . . element
32 . . . circumferential portion
34 . . . element
36 . . . fluid contact ring
37 . . . ink meniscus
38 . . . planarizing element
40 . . . fluid contact ring
42 . . . fluid contact ring
44 . . . selectably removable element
46 . . . hydrophobic material
48 . . . ink flow blocking element
50 . . . heat spreading element

What is claimed is:

1. An ink jet print head comprising:

a structure including a plurality of nozzles;

an element symmetrically disposed around each of first nozzles of said plurality of nozzles and adapted to cooperate with its respective nozzle in providing respective ink droplet ejections from the respective first nozzles that are aligned; and a corrected variant second nozzle having the element symmetrically disposed around the variant second nozzle that is altered by having material removed from the element to render the element an asymmetric element, the asymmetric element being adapted to cooperate with its respective nozzle to provide for respective ink droplet ejections from the second nozzle that are aligned with the ink droplet ejections from the first nozzles.

2. The ink jet print head of claim 1 and wherein the removed portion of the element comprises a circumferential portion of the element.

3. The ink jet print head of claim 2, and wherein the circumferential portion of the element was removed by ablation thereof.

4. The ink jet print head of claim 1, and wherein the element symmetrically disposed around each of the nozzles comprises a material having a thermal conductivity and position relative to the nozzle such that when the material is heated the element controls directional movement of the droplet from the nozzle.

5. The ink jet print head of claim 4, and wherein the material comprises an evaporated metal.

6. The ink jet print head of claim 4, and wherein the element comprises a fluid contact ring.

7. The ink jet print head of claim 1, and wherein the element symmetrically disposed around each of the nozzles comprises a layer of hydrophobic material.

8. The ink jet print head of claim 1, and wherein the element symmetrically disposed around each of the nozzles comprises an ink flow blocking material.

9. The ink jet print head of claim 1, and wherein the element symmetrically disposed around each of the nozzles comprises a layer of a heat blocking material.

10. The ink jet head of claim 1, and wherein the element asymmetrically disposed around the nozzle that is altered to comprise an asymmetric element comprises a layer of a heat blocking material.

11. A method of correcting an ink jet print head having a plurality of nozzles, the method comprising:

providing an ink jet print head structure including a plurality of nozzles, the plurality of nozzles including a plurality of first nozzles and a second nozzle, the structure including an element symmetrically disposed around each of said plurality of nozzles and adapted to cooperate with its respective nozzle in providing respective ink droplet ejections, from the respective plurality of first nozzles, that are aligned;

identifying a variant second nozzle from said plurality of nozzles that is characterized by ink droplet ejections that are not aligned with ink droplet ejections from the plurality of first nozzles;

removing material from the symmetrically disposed element around the variant second nozzle so as to render the element an asymmetric element, the asymmetric element being adapted to cooperate with its respective nozzle to provide for respective ink droplet ejections that are aligned with the ink droplet sections from the first nozzles.

12. The method of claim 11 and wherein a portion of the element is removed by ablation.

13. The method of claim 12 and wherein the ablation is performed using a laser.

14. The method of claim 11 and wherein the element disposed around each nozzle comprises a material having a thermal conductivity and position relative to the nozzle such that when the material is heated the element controls directional movement of a droplet from the respective nozzle.

15. The method of claim 14 wherein the material comprises an evaporated metal.

16. The process of claim 11 wherein the element symmetrically disposed around the nozzle comprises a fluid contact ring.

17. The process of claim 11 wherein the element symmetrically disposed around the nozzle comprises a layer of a hydrophobic material.

18. The process of claim 11 wherein the element symmetrically disposed around the nozzle comprises an ink flow blocking material.

19. The process of claim 11 wherein the element symmetrically disposed around the nozzle comprises a layer of a heat blocking material.

20. The ink jet print head of claim 1 and wherein the symmetrical element is under stress from having been deposited in a state of tensile stress.

21. The ink jet print head of claim 20 and wherein the element is of a material selected from the group consisting of a nitride, polysilicon or an evaporated metal.

22. The ink jet print head claim 1 and wherein the symmetrical element includes a plurality of non-contiguous elements.

23. The method of claim 22 wherein material is partially removed from one of the non-contiguous elements to form the asymmetric element.

24. The method of claim 11 and wherein the symmetrical element is under stress from having been deposited in a state of tensile stress.

25. The method of claim 24 and wherein the element is of a material selected from the group consisting of a nitride, polysilicon or an evaporated metal.

26. The method of claim 11 and wherein the symmetrical element includes a plurality of non-contiguous elements.

27. The method of claim 26 and wherein material is partially removed from one of the non-contiguous elements to form the asymmetric element.

* * * * *